US010555070B2

(12) United States Patent
Yoo

(10) Patent No.: US 10,555,070 B2
(45) Date of Patent: Feb. 4, 2020

(54) HYBRID SPEAKER

(71) Applicant: EARBRIDGE INC., Incheon (KR)

(72) Inventor: Okjeong Yoo, Pocheon-si (KR)

(73) Assignee: EARBRIDGE INC., Incheon (KR)

( * ) Notice: Subject to any disclaimer, the term of this patent is extended or adjusted under 35 U.S.C. 154(b) by 0 days.

(21) Appl. No.: 15/768,607

(22) PCT Filed: Sep. 29, 2017

(86) PCT No.: PCT/KR2017/011032

§ 371 (c)(1),
(2) Date: Apr. 16, 2018

(87) PCT Pub. No.: WO2018/093043

PCT Pub. Date: May 24, 2018

(65) Prior Publication Data

US 2019/0268688 A1 Aug. 29, 2019

(30) Foreign Application Priority Data

Nov. 21, 2016 (KR) ..... 10-2016-0155158

(51) Int. Cl.
*H04R 9/02* (2006.01)
*H04R 1/24* (2006.01)
(Continued)

(52) U.S. Cl.
CPC ..... *H04R 1/24* (2013.01); *H04R 7/02* (2013.01); *H04R 9/025* (2013.01); *H04R 9/046* (2013.01);
(Continued)

(58) Field of Classification Search
CPC . H04R 1/24; H04R 7/02; H04R 9/025; H04R 9/046; H04R 9/063; H04R 2209/022
See application file for complete search history.

(56) References Cited

U.S. PATENT DOCUMENTS 9,980,050 B2 * 5/2018 Boyd ..... H04R 7/24
2005/0271236 A1 * 12/2005 Kobayashi ..... H04R 1/24 381/396
2013/0121522 A1 5/2013 Flavignard et al.

FOREIGN PATENT DOCUMENTS

JP 2005-27286 1/2005
KR 10-0872543 12/2008
(Continued)

OTHER PUBLICATIONS

Written Opinion for International Application No. PCT/KR2017/011032 with English translation, dated Jan. 17, 2018.
(Continued)

*Primary Examiner* — Brian Ensey
(74) *Attorney, Agent, or Firm* — Kile Park Reed & Houtteman PLLC

(57) ABSTRACT

The present invention is related to a hybrid speaker comprising a tweeter and a dynamic woofer, wherein the tweeter has upper and lower coils arranged opposite to each other, an open-type high-tone vibration plate formed with a closed-type center hole at its center and located between the upper and lower coils, and one or more permanent magnets arranged outside the upper and lower coils, and wherein the woofer is coaxially coupled to a lower side of the tweeter so as to let low tone sound generated from a low tone vibration plate of the woofer pass through the hole of the high tone vibration plate of the tweeter.

10 Claims, 22 Drawing Sheets

(51) Int. Cl.
*H04R 7/02* (2006.01)
*H04R 9/04* (2006.01)
*H04R 9/06* (2006.01)

(52) U.S. Cl.
CPC ..... *H04R 9/063* (2013.01); *H04R 2209/022* (2013.01)

(56) References Cited

FOREIGN PATENT DOCUMENTS

| | | |
|---|---|---|
| KR | 10-1460170 | 11/2014 |
| KR | 10-1596894 | 2/2016 |

OTHER PUBLICATIONS

International Search Report for International Application No. PCT/KR2017/011032, dated Jan. 17, 2018.

* cited by examiner

HYBRID SPEAKER

FIELD OF THE INVENTION

The present invention is directed to a hybrid speaker. More particularly, the present invention is directed to the hybrid speaker capable of emitting low tone sound from a woofer by coaxially coupling a dynamic woofer under an electro-magnetic tweeter and minimizing distortion due to phase interference occurring in a non-coaxial state. Accordingly, the hybrid speaker of the present invention is suitable for extension of band pass from a zone of low tone sound to a zone of high tone sound and for achieving high quality of sound.

BACKGROUND

Generally, an electro-magnetic speaker is the same as a dynamic speaker in respect of their operation principle, wherein magnetic field lines of alternating current generated from wire-winding coils interacts with magnetic field lines of direct current induced from a permanent magnet. However, differing from the dynamic speaker where the coils are directly driven, whereas the electro-magnetic speaker performs electro-acoustic conversion by fixing the coils and magnetizing an iron piece mounted to an end of the coils to vibrate the same.

The electro-magnetic speaker comprises a balanced armature speaker and a plate type speaker and KR 1596894 discloses the plate type speaker falling under the electro-magnetic speaker.

Referring to the electro-magnetic speaker of the above-mentioned KR patent, upper coils are arranged opposite to lower coils; one or more permanent magnets are located outside of the upper and lower coils; a vibration plate is disposed between the upper and lower coils; and peripheries of upper and lower surfaces of the vibration plate are supported by upper and lower damper members.

A process for driving the vibration plate of the above-described conventional electro-magnetic speaker will be described. First, provided that an upper face of the permanent magnet is the South pole and that a lower face of the permanent is the North Pole, the inner magnetic field direction of the upper coils and the inner magnetic field direction of the lower coils are opposed to each other in an inward direction, when electric currents are in a plus (+) period, and thus, the vibration plate moves upward because it becomes the North pole.

When the electric currents are zero, the vibration plate is neutralized and the vibration plate moves toward a neutral position by itself due to magnetic field balancing of the upper and lower permanent magnets and restoring force of the vibration plate.

When the electric currents are in a minus (−) period, the inner magnetic field direction of the upper coils and the inner magnetic field direction of the lower coils are opposed to each other in an outward direction, and thus, the vibration plate moves downward because it becomes the South pole.

In the above-described electro-magnetic speaker, the vibration plate is magnetized by electro-magnetic force of the upper and lower coils and it is directly driven in reaction to the magnetic force of the permanent force while coil weight is excluded. Accordingly, a fast response is obtained corresponding to electric sounds, so that it is possible to obtain very fine and detailed sound reproduction thereby.

Also, the vibration plate of the electro-magnetic speaker performs acoustic conversion, while it is actively driven by itself. Thereby, it is possible to minimize distortion rate of conversion path of the vibrator, so that it is advantageous to the more clear sound reproduction.

In the conventional electro-magnetic speaker described above, however, since the vibration plate is prepared as an integrated unitary vibration plate in a plate form, such as a circular plate or an elliptical plate, the extension of high tone-zone is restricted. If the vibration plate has the shape such as a dome and a cone, it is possible to cover the entire band pass. However, due to strong elasticity that is the property of amorphous alloy material, it is difficult to form and manufacture the vibration plate, and thus, cost increases.

Also, since the integrated unitary vibration plate in a plane shape is supported by upper and lower damper members and a gap guide is provided in their outside, a space for covering amplitude is needed and magnetic resistance increases. Accordingly, efficiency decreases and the thickness of the speaker increases.

Particularly, although the conventional electro-magnetic speakers have a better resolution, most of them show restrictive performance with regard to the extension in low tone sound and ultra high tone sound. Thus, an improvement is being required in order to meet the recent digital audio market, wherein musical elements of low and high tones are much included and are more refined and wherein the dynamic range extends. Accordingly, a combined-type multi-way speaker, which has a higher capability and a reproduction property of ultra broadband width, is required for the purpose of reproducing a superior quality sound.

SUMMARY OF THE INVENTION

The present invention is developed so as to overcome the disadvantages of the conventional speaker as described above. The object of the present invention is to provide a hybrid speaker, wherein a multi-way speaker is readily established by coaxially coupling a dynamic woofer to a lower side of an electro-magnet tweeter and wherein band extension from the zone of low tone to the zone of high tone and high quality of sound are attained, while minimizing distortion due to phase interference occurring when in non-coaxial state.

The other object of the present invention is to provide a hybrid speaker, wherein low tone sound is emitted from the woofer while flattening and smoothing the characteristics of mid-tone and high-tone by providing a porous resister between the electro-magnetic tweeter and the dynamic woofer in order to alleviate the disadvantage of a multi-way speaker, i.e., the undulation of the characteristics in a crossover zone in which a zone of low tone and a zone of high tone overlap. Accordingly, the multi-way is attained wherein the smooth engagement of the characteristics is possible from the low tone sound to the high tone sound.

The other object of the present invention is to provide a hybrid speaker, wherein an open-type high tone vibration plate is formed with at least one hole at its center or a plurality of vibration wings, wherein low tone sound generated from a body of the high tone vibration plate and the vibration wings disappears due to anti-phase by itself. Accordingly, the engagement with the characteristic generated from the woofer is possible, and thus, the extension of high tone-zone and the fine adjustment are very advantageous.

The other object of the present invention is to provide the hybrid speaker, wherein an open-type high tone vibration plate is directly attached to the upper and lower coils or the upper and lower permanent magnets without any clearance.

Accordingly, the fine control and the ultrahigh resolution could be achieved in high frequency band ranging from high band to ultrahigh band, while the efficiency in high tone part could be effectively improved.

The other object of the present invention is to provide a hybrid speaker enabling the assembly of at least upper and lower coils and upper and lower permanent magnets to a flexible printed circuit board (FPCB) using a double sided adhesive pad by providing an integrated electrode member, i.e., the flexible printed circuit board and the double sided adhesive pad. Accordingly, the main assembly process could be minimized to include about 10 steps and be simplified. Also, the hybrid speaker adapted to the automation of assembly line could be provided.

In order to achieve the above objects, the present invention provides a hybrid speaker comprising a tweeter and a dynamic woofer, wherein upper and lower coils are arranged opposite to each other, wherein an open type-high tone vibration plate formed with a closed type-hole at its center is provided between the upper and lower coils, wherein one or more permanent magnets are arranged outside the upper and lower coils, and wherein the dynamic woofer is coaxially coupled to the lower side of the tweeter in order to let low tone sound generated from a low tone vibration plate of the woofer emit pass through the hole formed in the high tone vibration plate of the tweeter.

A porous resister for controlling high tone is provided between a high tone vibration plate of the tweeter and a low tone vibration plate of the woofer in order to alleviate undulation of the characteristics within a crossover region wherein a zone of low tone sound and a zone of high tone sound are overlapped.

The tweeter and the woofer are provided with a coaxial housing for coaxially coupling them by enclosing outer surfaces of their frames and a basket.

In the hybrid speaker of the present invention, the vibration plate of the tweeter is formed with a plurality of vibration wings by cutting an inner periphery of the hole in a radial direction, wherein every vibration wing is formed with an adjustment hole or some of the vibration plates are selectively formed with adjustment holes.

In the hybrid speaker of the present invention, the vibration plate of the tweeter is made of ferromagnetic body, such as iron, nickel, silicon.

In the hybrid speaker of the present invention, the upper and lower coils and the upper and lower magnets have the same sizes and are symmetrically arranged in a vertical direction and peripheral edge of the high tone vibration plate is directly supported by the upper and lower coils and the magnets.

In the hybrid speaker of the present invention, the upper and lower coils are wired in such a way that the magnetic field lines of the upper and lower coils are opposed to each other.

In the hybrid speaker of the present invention, the upper and lower coils, the upper and lower magnets and the vibration plate are coaxially arranged in the frame, wherein the frame is formed with a first sound emission hole at a center of its upper surface and wherein the upper and lower magnets have the same directions of magnetization.

In the hybrid speaker of the present invention, the upper and lower coils forms a parallel coupling by way of the integrated electrode member made of a flexible printed circuit board (FPCB).

The integrated electrode member is integrally provided with an upper electrode member covering an upper surface of the upper coils, a lower electrode member covering a lower surface of the lower coils, a connection track connecting the upper and lower electrode members and an outer electrode terminal member extending from the lower electrode member to form a straight line with the connection track, wherein two electrode terminals are provided at a respective side of the upper and lower electrode members, wherein two electrode terminals are provided at an end of the outer electrode terminal member and wherein drawing lines of the upper and lower coils are respectively coupled to the electrode terminals to form a pair of electrode patterns.

The integrated electrode member is assembled by attaching the upper coils and the upper magnet to the upper electrode member by means of double sided adhesive pad, attaching the lower coils and the lower permanent magnet to the lower electrode member by means of double sided adhesive pad and arranging the vibration plate between the upper and lower coils, wherein both ends of the connection track are bent so as to coaxially arrange the upper and lower coils and the vibration plate and the upper and lower coils and the vibration plate are inserted in the frame.

In the hybrid speaker of the present invention, the frame comprises a cap shaped member, wherein a first sound emission hole is formed at a center of its upper surface and wherein a coil molding hole is formed at a side of the cap shaped member and an electrode drawing slot for drawing an electrode is formed at the other side of the cap shaped member.

In the hybrid speaker of the present invention, the high tone vibration plate of the tweeter is supported between the upper and lower damping members and a gap guide is provided for establishing sufficient space between the upper and lower permanent magnets outside the upper and lower damping members.

Advantages of the Invention

In the hybrid speaker of the present invention, a dynamic woofer is coaxially coupled to a lower side of the electromagnet tweeter, which has an open-type high tone vibration plate formed with a hole at its center or with vibration wings. Accordingly, it is possible to provide a wideband multi-way speaker without loss and distortion due to phase interference occurring in a non-coaxial state.

In the hybrid speaker of the present invention, the characteristics of mid tone sound and high tone sound, which are emitted from a woofer through a porous resister between the electro-magnet tweeter and the dynamic woofer, are flattened and smoothed, so that low tone sound is emitted toward the tweeter. Accordingly, it is possible to smoothly engage the characteristics within a crossover zone where low tone sound and high tone sound are crossed.

In the hybrid speaker of the present invention, the vibration wings has very light mass, because the high tone vibration plate has an open type, which comprises a plurality of vibration wings at its center. Also, it is possible to remove unnecessary low tone sound by adjusting a space between the vibration wings. At the same time, it is possible to extend a zone of high tone and to perform the fine adjustment.

In the hybrid speaker of the present invention, the high tone vibration plate of the open type is directly coupled and supported by means of the upper and lower permanent magnets and the upper and lower coils without any clearance, to thereby reduce the magnetic resistance. Accordingly, it is possible to improve the efficiency in a high frequency band and to attain a slim appearance.

In the hybrid speaker of the present invention, a flexible printed circuit board and an integrated electrode member are used for attaching them to at least the upper and lower coils or the upper and lower permanent magnets, to thereby assemble these elements as an integrated piece. Accordingly, the main assembly process is minimized to include about 10 steps and it is simplified. Further, the assembly line could be adapted to the automation.

In the hybrid speaker of the present invention, ends of the upper and lower coils are drawn through coil guiding tracks of the integrated electrode member. Thereafter, the ends of the coils are collectively bent toward a side using a roller. Accordingly, it is possible to attain the automation of the assembly line and the improvement in the productivity.

DETAILED DESCRIPTION OF THE INVENTION

Figure 1:
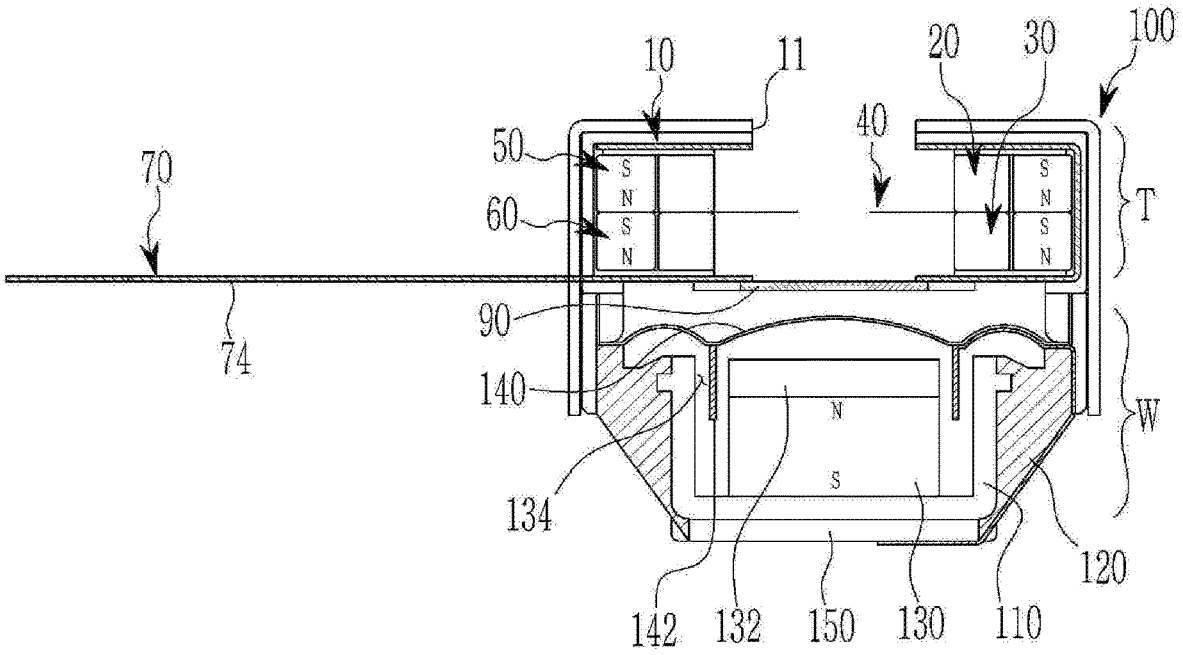
FIG. 1 is a cross-sectional view of a hybrid speaker according to a preferred embodiment of the present invention.
Figure 2:
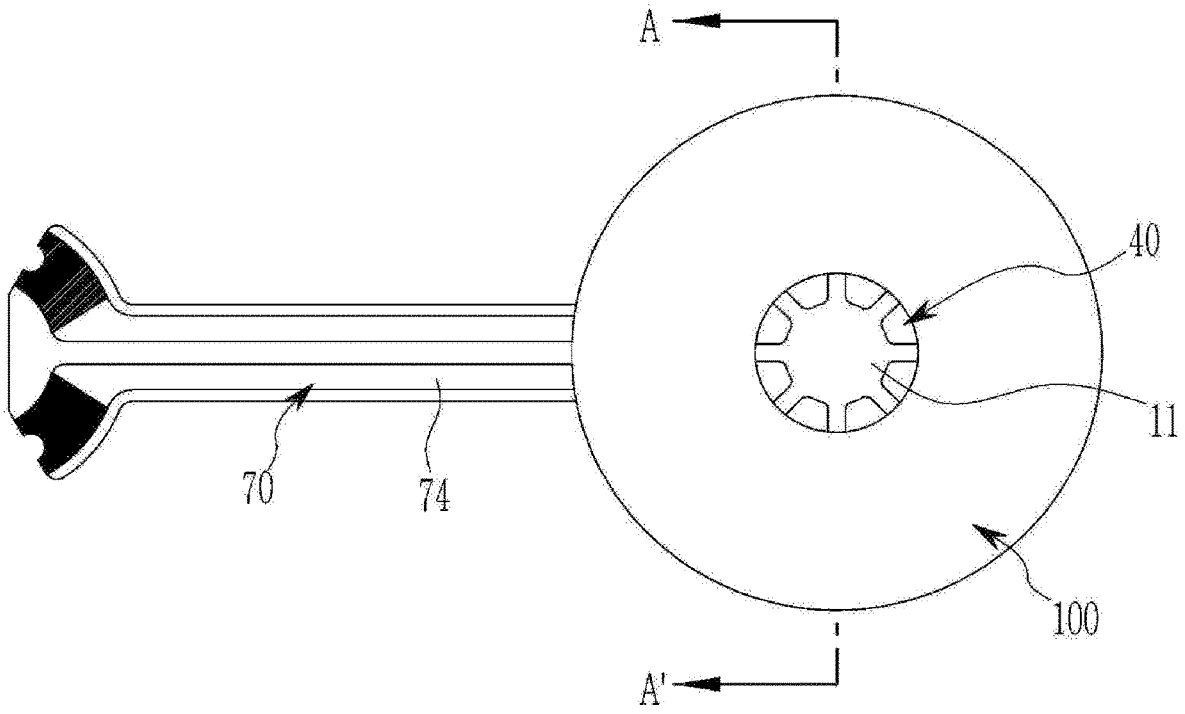
FIG. 2 is a planar view of FIG. 1.

Herein-below, the present invention will be described with reference to the attached drawings of the hybrid speaker according to preferred embodiments of the present invention. Sizes of elements and thicknesses of lines in the drawings might be somewhat exaggerated for the convenience of explanation. Terms and nomenclatures in the specification are defined in consideration of functions in the present invention, but they might be changed depending of an operator's intention and custom. Thus, the terms and the nomenclatures should be defined based on the whole contents of the specification.

FIGS. 1-9 are the drawings for showing a hybrid speaker according to a preferred embodiment of the present invention.

As shown in the drawings, the hybrid speaker of the present invention comprises a tweeter T and a dynamic woofer W, wherein said tweeter T has an open-type high tone vibration plate 40 formed with vibration wings 44, together with a closed-type hole 43 at a center and wherein said dynamic woofer W is coaxially coupled to a loser side of the tweeter T, so as to allow low tone sound generated from a low tone vibration plate to pass through a hole 43 formed at a high tone vibration plate 140 of the tweeter T.

A resister 90 for controlling high tone is provided between the high tone vibration plate 40 of the tweeter T and the low tone vibration plate 140 of the woofer W, so as to control fine tone sound, which ranges from middle tone to high tone, generated from the low tone vibration plate 140 of the woofer W. The resister 90 for controlling high tone is provided on a lower electrode member 72 to cover a second member aperture 72*b* of an integrated electrode member 72. Also, the resister 90 for controlling high tone is preferably made of porous material. For instance, non-woven fabric, micro-perforated material, etc., may be used for the resister 90.

The tweeter T and the woofer W are coaxially coupled to each other by a coaxial housing 100, which wraps a frame 10 and an outer circumference of a basket 120. The coaxial housing 100 has a cap shape, which is the same as that of the frame 100 as described below. The coaxial housing 100 is formed with an aperture for emitting sound at a center of its upper face and is manufactured from non-magnetic material, such as aluminum.

The tweeter T comprises a cap shaped frame 10, upper coils 20 mounted to an upper space in the frame 10, lower coils 30 oppositely arranged under the upper coils 20, the high tone vibration plate 40 arranged between these coils, and upper and lower permanent magnets 50 and 60 arranged outside the coils. The upper and lower coils 20, 30 of the tweeter T are connected to form a circuit, so as to be controlled by means of the integrated electrode member 70. As shown by phantom lines in FIG. 4 and FIG. 20, the integrated electrode member 70 is bent, so that it is connected to a substrate 150 of the woofer W so as to form a circuit.

Since the frame 10 has to form an installation space for receiving the upper and lower coils 20 and 30, the high tone vibration plate 40, the upper and the lower permanent magnets 50 and 60, the integrated electrode member 70, etc., it is preferable for the frame to have the cap shape and to be manufactured from non-magnetic material, such as aluminum. The frame 10 is formed with a sound emission hole 11 at a center of its upper face and with a coil line molding hole 12 at a side. It is also formed with an electrode drawing slot 13 at the other side, in order to prevent a connection track 73 of the integrated electrode member 70 from being exposed and damaged.

Lead lines 21, such as plus and minus lead lines, are drawn at a side of the upper coils 20 and the these lead lines 21 of the upper coils 20 are coupled to a first electrode terminal 71*a*, which is formed at an upper electrode member 71 of the integrated electrode member 70. The upper coils 20 are assembled within the upper permanent magnet 50 and are installed in the frame 10.

The lower coils 30 are arranged opposite to the upper coils 20 with a spacing there-between, which corresponds to a thickness of the high tone vibration plate 40. The lower coils are installed in the lower permanent magnet 60 within a lower space of the frame 10.

The lower coils 30 have draw lines 31, such as plus (+) and minus (−) draw lines at a side. The draw lines 31 of the lower coils 30 are coupled to a second electrode terminal 72*a*, which is formed on a lower electrode member 72 of the integrated electrode member 70.

As mentioned above, the upper permanent magnet 50 is arranged outside the upper coils 20, while the lower permanent magnet 60 is arranged outside the lower coils 30. The permanent magnets are formed to have a washer shape.

Also, the upper coils 20 and the lower coils 30 are wired in such a manner that their lines of magnetic forces are opposed to each other. Accordingly, the high tone vibration plate 40 that is electro-magnetized obtains driving forces from these upper and lower coils 20, 30. The high tone vibration plate 40 vibrates upward and downward in response to plus (+) and minus (−) signals that are electrically and periodically applied to the upper and lower coils 20, 30.

The high tone vibration plate 40 is directly and tightly installed between the upper and lower coils 20, 30 without any gap, wherein the upper coils 20 are symmetrically and coaxially coupled to the lower coils 30. The high tone vibration plate 40 has a body 41 performing such main function as vibration and an edge 42 provided along an outside. The high tone vibration plate is provided in an open-type, wherein the closed-type hole 43 is punctured at a center of the body 41 and wherein a plurality of vibration wings 44 are formed in a radial direction around the hole 43. The high tone vibration plate 40 is made from ferromagnetic material, such as iron, nickel, silicon and like.

The high tone vibration plate 40 is directly installed between the upper and lower coils and the permanent magnets, all of which have the same sizes and symmetrical arrangements. Accordingly, any space for vibration is not necessary, to thereby achieve a slim shape. Also, the high tone vibration plate is directly driven by the electromagnetic force of the upper and lower coils 20, 30, so that magnetic resistance decreases, while efficiency increases. As a result, since the fast response is attained corresponding to electric signals, it is possible to reproduce very fine sound.

Figure 3:
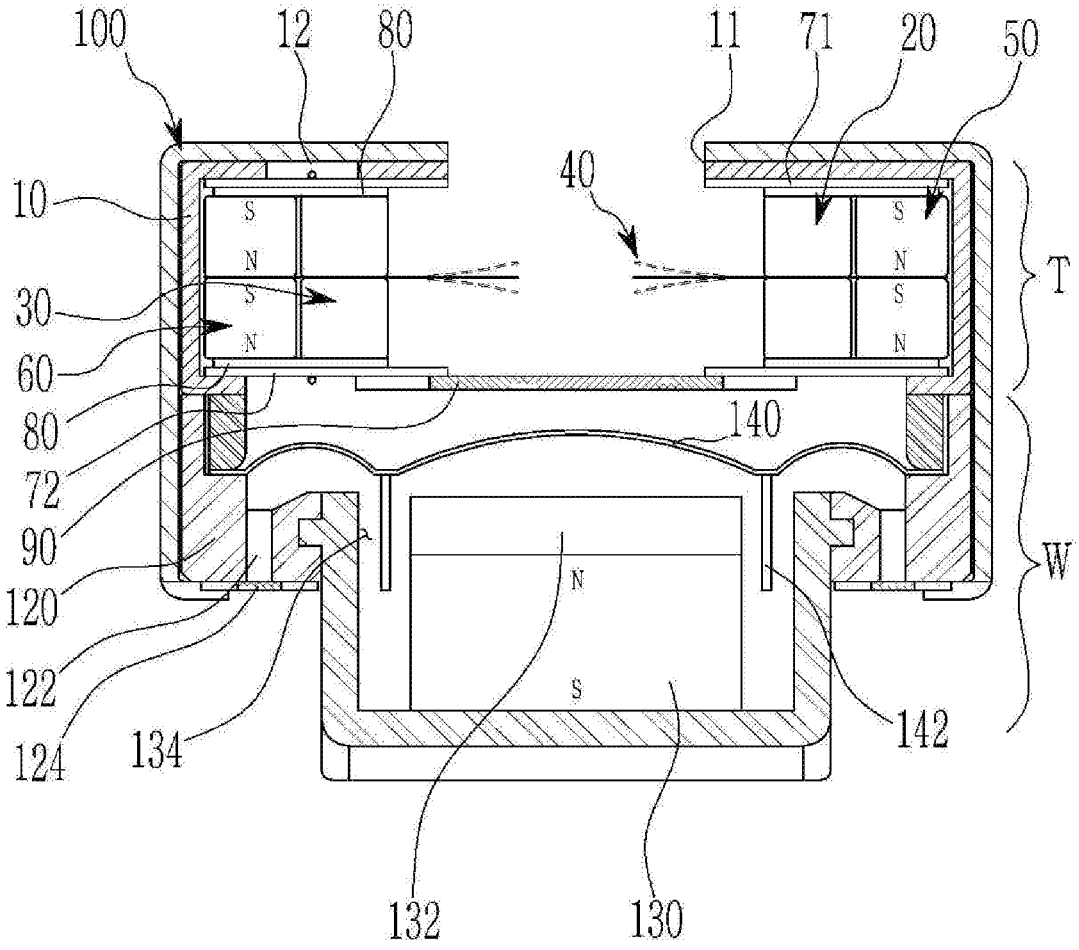
FIG. 3 is a cross-sectional view of FIG. 2 along a line A-A'.
Figure 4:
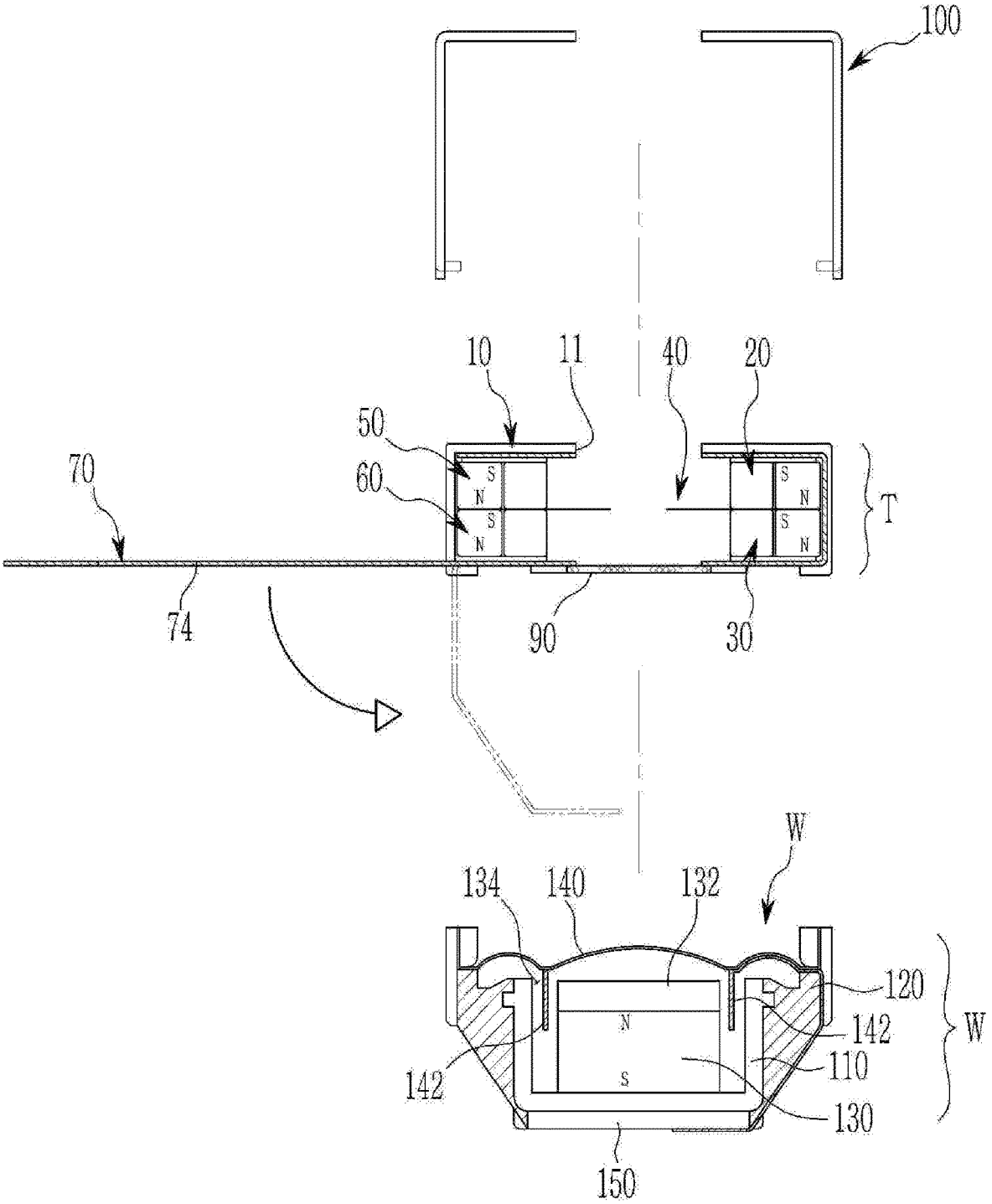
FIG. 4 is a cross-sectional view, wherein the hybrid speaker of the present invention is exploded to show a tweeter and a woofer.
Figure 5:
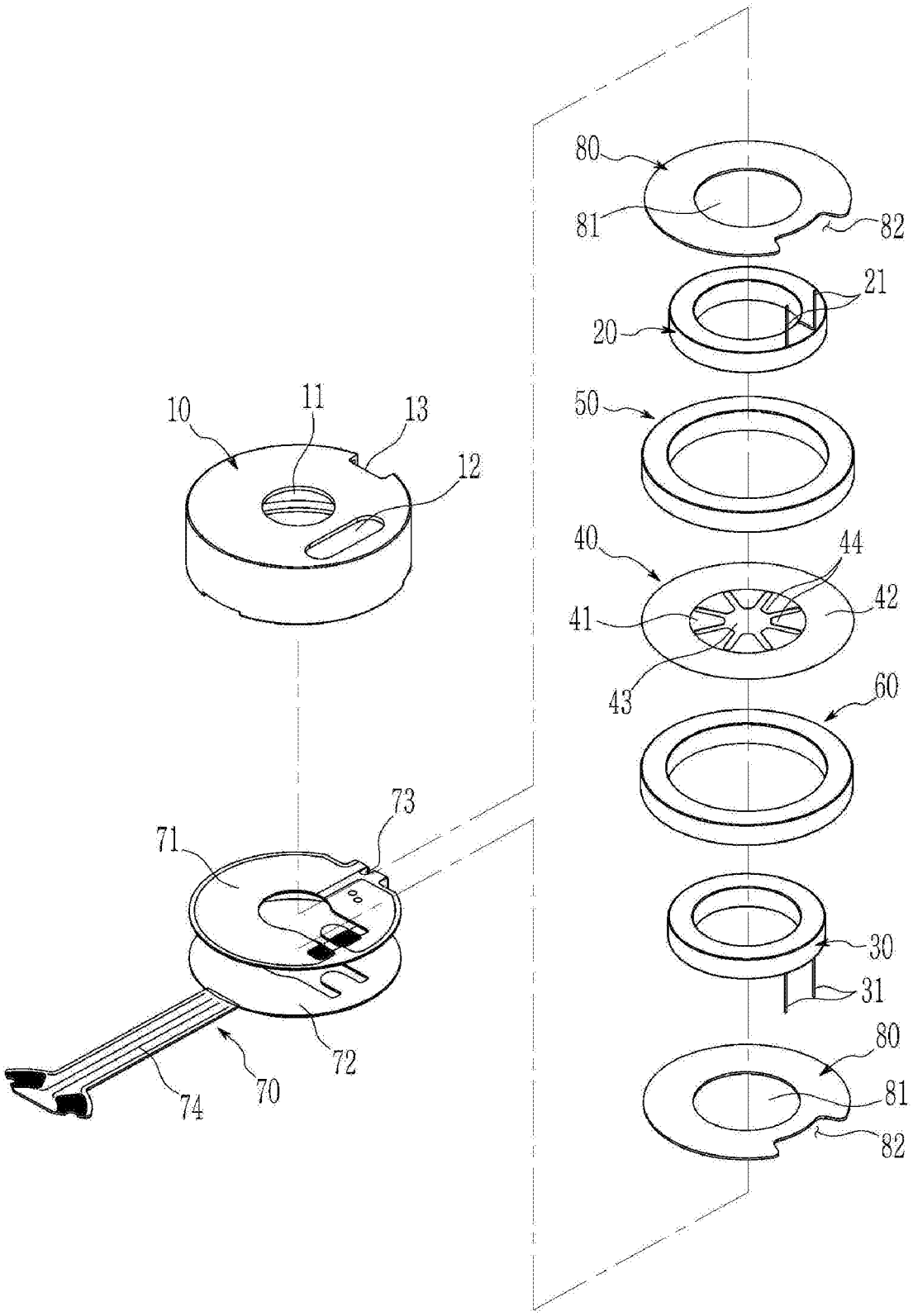
FIG. 5 is an exploded view showing the tweeter extracted from the hybrid speaker of the present invention.
Figure 6:
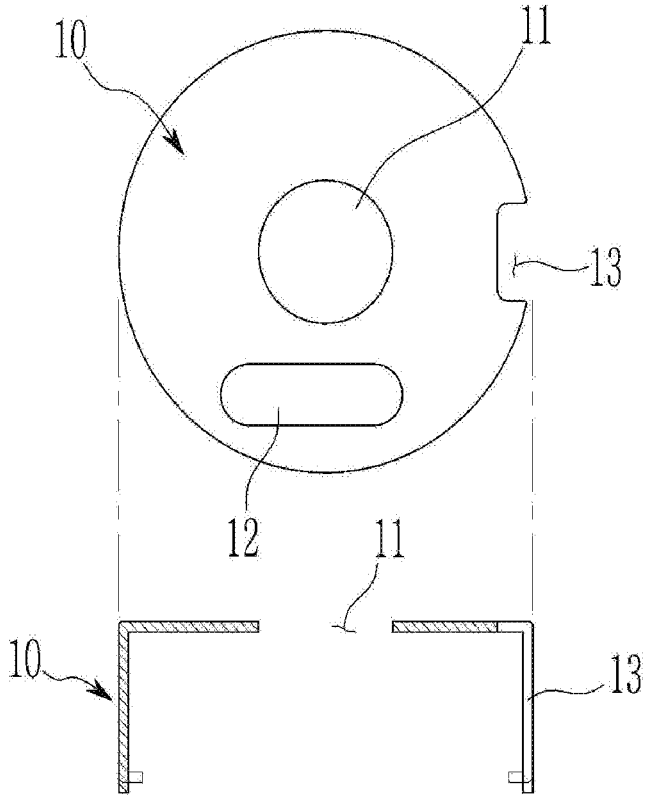
FIG. 6 is a planar view and a cross sectional view of a frame applied to the tweeter of the present invention.
Figure 7:
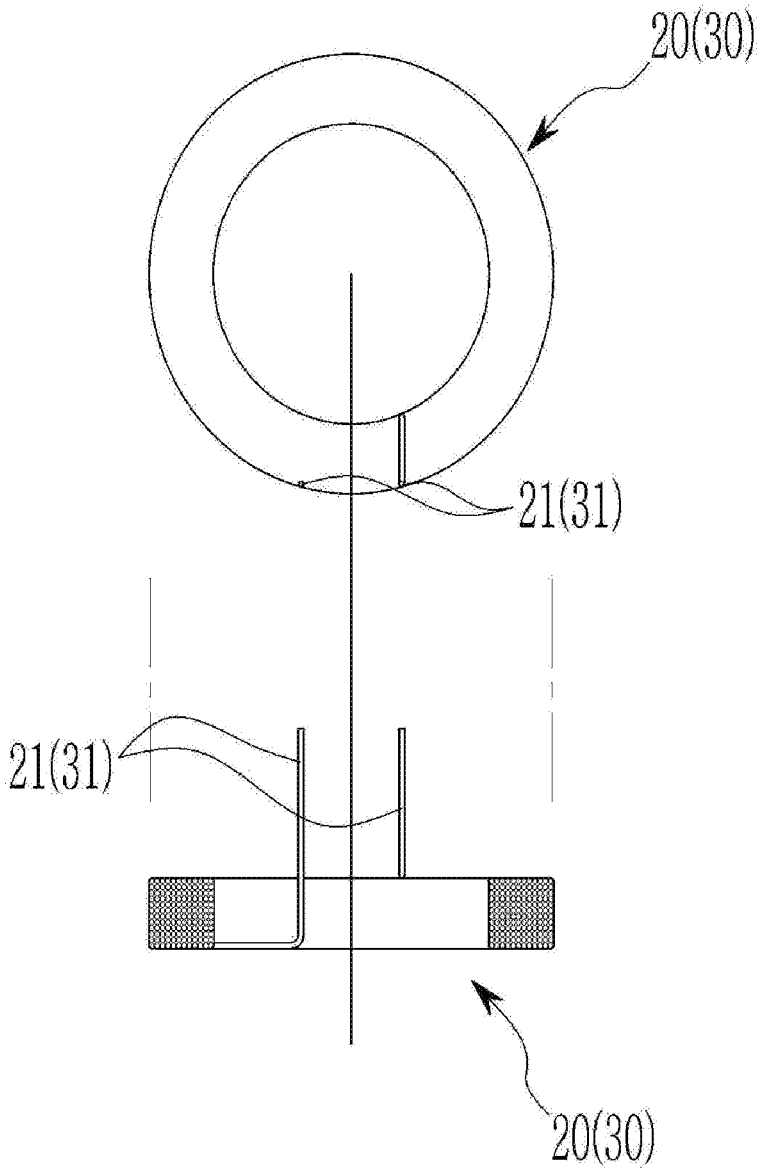
FIG. 7 is a planar view and a cross section view of coils applied to the tweeter of the present invention.
Figure 8:
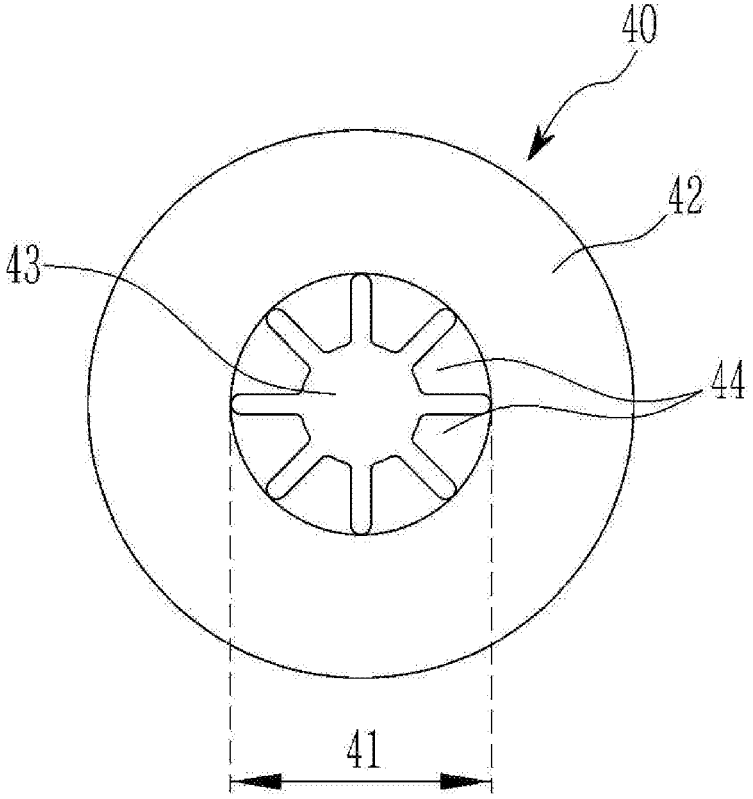
FIG. 8 is a perspective view of a vibration plate applied to the tweeter of the present invention.
Figure 9:
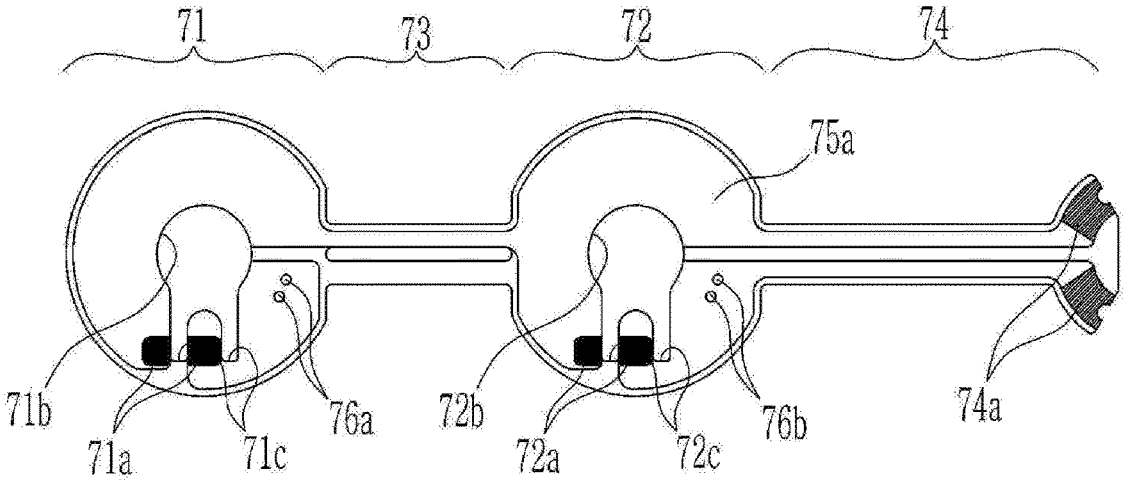
FIG. 9 is a planar view and a bottom view of an integrated electrode member applied to the tweeter of the present invention.
Figure 9:
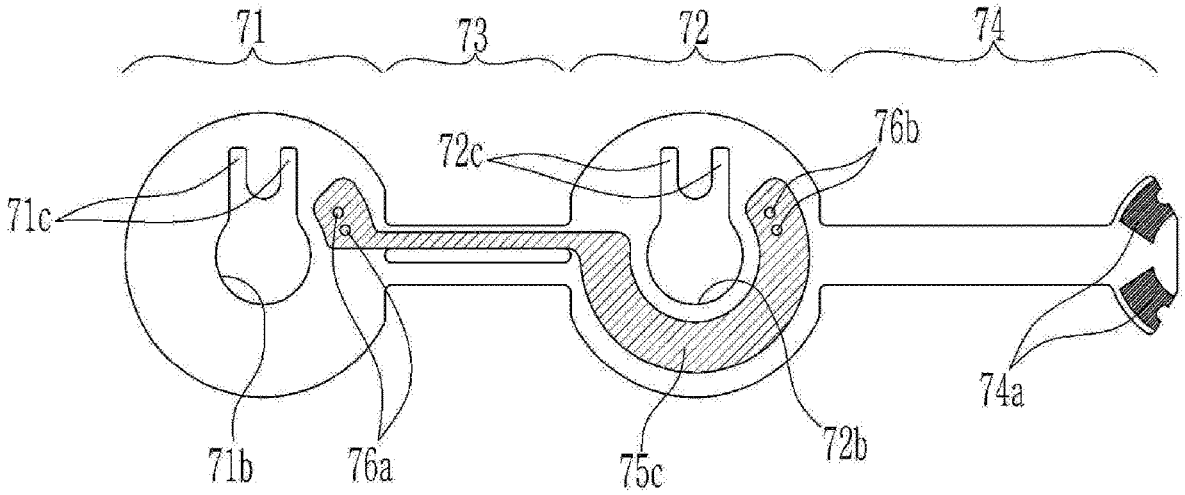
Figure 10:
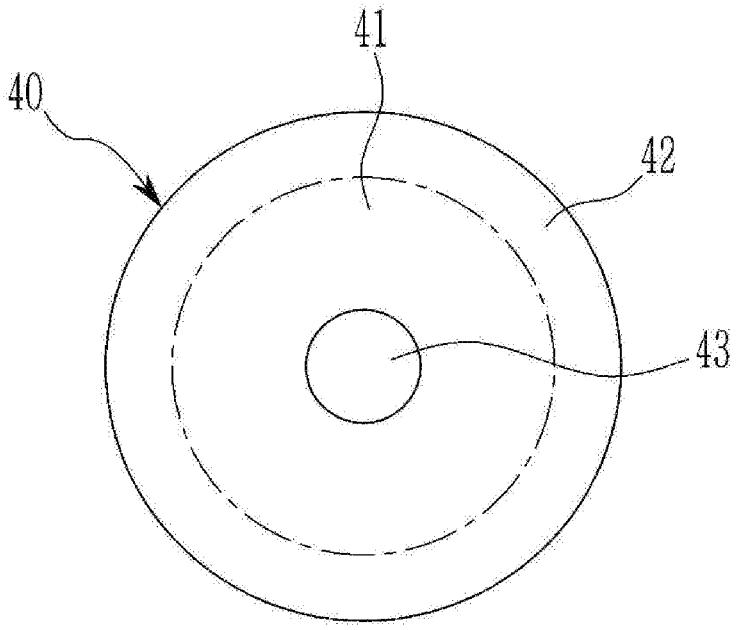
FIGS. 10 and 11 are planar views shows vibration plates of other embodiment applied to the tweeter of the present invention.

Specifically, the high tone vibration plate 40 vibrates in such a manner that the vibration wings 44 moves in an arch indicated with phantom lines of FIG. 3 based on a circumference (i.e. the phantom line on the vibration plate in FIG. 5) corresponding to inner diameters of the upper and lower coils 20, 30, while its outer periphery is supported by the upper and lower coils 20, 30.

More specifically, since the vibration wings are freely driven in an arch path like a cantilever based on the root of the vibration wings 44 corresponding to the edge 42 adjacent to an outer periphery of the body 41, the vibration wings are electro-magnetized and directly act to the magnetic force of the upper and lower permanent magnets 50 and 60, so that they are driven by itself. When the vibration wings 44 of the high tone vibration plate 40 are freely driven in the arch path, the low tone-sound generated from the vibration wings 44 disappears due to anti-phase resulting from the up-down movement of the vibration wings in the arch path and only the high tone sound is generated and emitted.

The high tone vibration plate 40 is directly and tightly supported by the upper and lower coils 20, 30 and the upper and lower magnets 50, 60 without any gap there-between. Accordingly, the vibration plate 40 becomes a self-driven active vibrator, while it is magnetized by the electromagnet fields that are alternated and interlinked with electric signals in the upper and lower coils 20 and 30. As a result, the vibration plate has very fast response to electric signals, and thus, very fine and detailed reproduction of sound is possible. Also, it is possible to achieve ultra high resolution in a high frequency band ranging from high band to ultra high band.

Although the high tone vibration plate 40, which has the vibration wings 44 extending from the center hole 43 in a radial direction, is illustrated, it is possible to provide a vibration plate only with the center hole 43 of the closed type. In that case, the body 41 around the hole 43 vibrates, while moving up and down in the arch path, based on the circumference corresponding to the inner diameter of the upper and lower coils 20 and 30. Accordingly, the low tone-sound generated from the body 41 of the vibration plate 40 by the hole 43 of the vibration plate 40 disappears due to anti-phase and only the high tone-sound generated by the arch movements of the body 41 of the vibration plate 40 is emitted.

The closed type hole 43 may be provided in various forms, such as an elliptical form, a rectangular form, other than a circular form. As the hole 43 of the high tone vibration plate 40 changes in its size and area, the disappearance zone of low tone sound changes, either. When the hole 43 has a small size and a small area, the disappearance zone of low tone sound is low. When a size and an area of the hole 43 increases, the disappearance zone of low tone sound is gradually extended toward a zone of high tone.

According to the size and the area of the hole 43 formed in the high tone vibration plate 40, the disappearance zone of low tone sound varies. At the same time, the zone of high tone changes, accordingly. Therefore, it is possible to design-change the size and the area of the hole 43 in many ways, and thus, the fine adjustment as well as the enlargement and the diversification for the zone of high tone zone may be advantageously attained.

The plus (+) electrodes of the upper and lower coils are coupled to each other, while the minus electrodes (−) of the upper and lower coils are coupled to each either. Thus, the upper and lower coils 20, 30 are coupled in parallel by way of an integrated electrode member 70 including a flexible printed circuit board (FPCB).

The integrated electrode member 70 has the upper and lower electrode members 71 and 72 connected through a connection track 73, wherein an outer electrode terminal member 74 extends from a side of the lower electrode member 72 to thereby form a rectilinear line along with the connection track 73.

The upper and lower electrode members 71, 72 are formed to have the same shapes and the same sizes as the planar shapes of the upper and lower coils 20, 30. First and second electrode members 71, 72 are provided with a pair of first electrode terminals 71*a* and a second electrode terminal 72*a*, respectively, at their side. The outer electrode terminal member 74 is provided with a pair of third electrode members 74*a* at its end. The first and second electrode terminals 71*a*, 72*a* of the integrated electrode member 70 are respectively coupled by the draw lines of the upper and lower coils 20, 30 and a pair of electrode patterns 75*a*, 75*b*, 75*c* are formed to attain a circuit with the third electrode terminals 71*a*, 72*b*.

The upper electrode member 71 is formed with a first member aperture 71*b* at its center and is formed with a coil guiding track 71*c* in a U-shape for guiding the draw lines 21 of the upper coils 20 at a side of the first member aperture 71*b*, wherein the first member aperture is integrated with the coil guiding track. The first electrode terminals 71*a* are provided about the coil guiding track 71*c* for soldering the draw lines 21 of the upper coils 20.

The lower electrode member 72 is formed with a second member aperture 72*b* at its center and is formed with a coil guiding track 72*c* in a U-shape for guiding the draw lines 31 of the lower coils 30 at a side of the second member aperture 72*b*, wherein the second member aperture is integrated with the coil guiding track. The second electrode terminals 72*a* are provided about the coil guiding track 72*c* for soldering the draw lines 31 of the lower coils 30.

The upper and lower electrode members 71, 72 are formed with connector apertures 76*a*, 76*b* for electrically coupling the electrode pattern 75*c* on the lower surface to the electrode pattern 75*b* on the upper surface, because the electrode patterns 75*a*, 75*b*, which form the plus (+) poles and minus (−) poles on each surface to attain the circuits, should be electrically coupled to each other.

It is preferable that the integrated electrode member 70 is covered with an insulation sheet on its surface except for each electrode terminal for the purpose of insulation with respect to other parts.

A double sided adhesive pad 80 is a thin pad, which is provided for improving the assembly of the upper and lower coils 20, 30 to the integrated electrode member 70. The double sided adhesive pad 80 has the same planar shape as the assembly of the upper coils 20 and the upper permanent magnet 50 or the assembly of the lower coils 30 and the lower permanent magnet 60. The double sided adhesive pad 80 is formed with a hole 81 at its center and an arch shaped coil guiding part 82 at its circumference, wherein the hole 81 is punctured to have the same size as the inner diameter of the upper and lower coils 20, 30 and wherein the arch shaped coil guiding part 82 is formed not to prevent the drawing lines 21, 31 of the upper and lower coils 20, 30 from being drawn. Any type might be used as the double sided adhesive pad 80 if it has adhesive forces on either surface. It is preferable to have detachment sheet on either surface.

The woofer W is a dynamic low tone speaker which operates in a moving coil manner and which is suitable for zone of low tone. The woofer W has a basket 120 mounted on an upper and outer side of an empty yoke 110. Within the yoke 110, a permanent magnet 130 for low tone sound and a pole piece 132 are provided. A circumferential edge of a low tone vibration plate 140 is fixed to the basket 120. Within a space of an air gap 134 between the upper end of the yoke 110 and the pole piece 132, a voice coil 142 fixed to the central bottom of the low tone vibration plate 140 is installed to move upward and downward.

The substrate 150 for low tone sound is provided under a bottom of the yoke 110. The voice coil 142 is connected to the substrate 150 for low tone sound for the purpose of being controlled thereby.

The basket 120 is formed with one or more air holes 122. Each air hole 122 may be covered with a porous resister 124 for controlling low tone sound, which controls a low tone resonance frequency.

The operation of the woofer W is the same as that of a conventional moving coil. Briefly, magnetic field lines of alternating current generated from the voice coil 142 interacts with magnetic field lines of direct current induced from the permanent magnet 130 for low tone sound, so that the low tone sound is generated by upward and downward movements of the voice coil 142 and the low tone vibration plate 140.

With regard to the hybrid speaker of the present invention as discussed above, the assembly process for the tweeter T will be described below. First, the upper and lower permanent magnets 20, 30 are arranged on a work table and the upper and lower coils 20, 30 are inserted into the upper and lower permanent magnets 50, 60, respectively, so that the upper and lower magnetic circuits are obtained (See FIG. 2). Here, the draw lines 21 and 31 of the upper and lower coils 20 and 30 are drawn to protrude upward.

Figure 13:
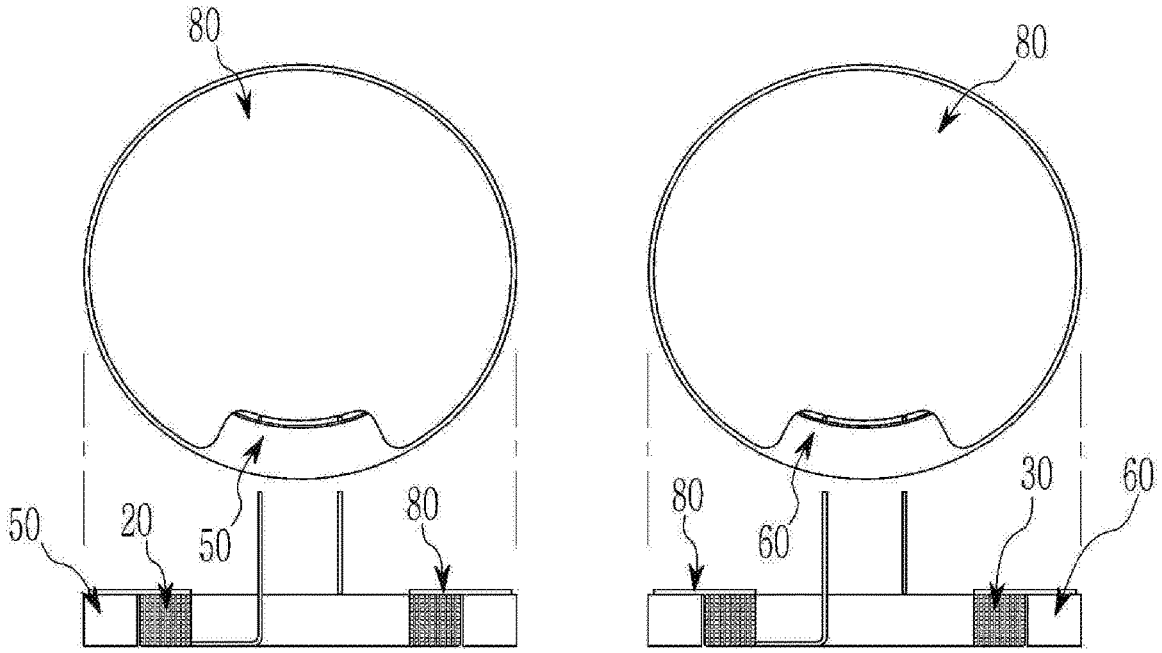

As described above, one of the double sided adhesive pads 80 is attached onto the upper permanent magnet 50 of the upper magnetic circuit, while the other of the double sided adhesive pads 80 is attached on the lower permanent magnet 60 of the lower magnetic circuit (See FIG. 13). Here, the draw lines 21, 31 of the upper and lower coils 20, 30 are positioned within the coil guiding part 82 so as to prevent plastic deformation.

Figure 14:
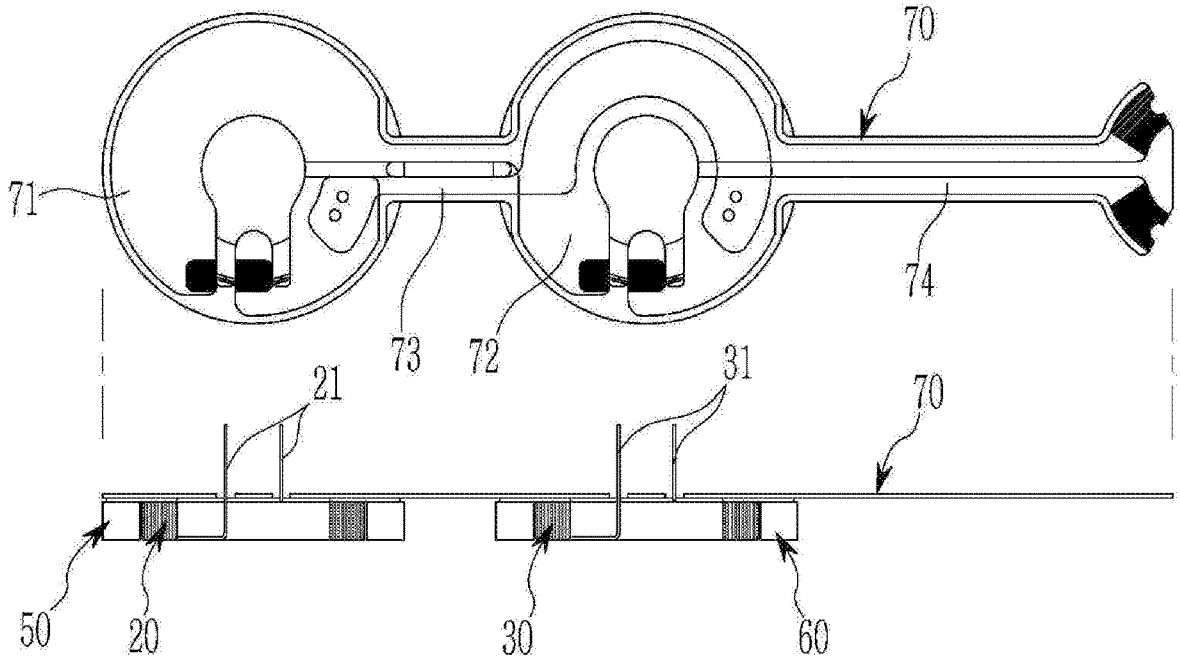

Thereafter, the integrated electrode member 70 is attached onto the upper surface of the double sided adhesive pad 80 above the upper and lower coils 20, 30, wherein the upper electrode member 71 is positioned above the upper coils 20 and the lower electrode member 72 is positioned above the lower coils 30 (See FIG. 14). Here, the attachment should be done in such a way that the first and second member apertures 71*b*, 72*b* of the upper and lower electrode members 71, 72 are consistent with the inner diameters of the upper and lower coils 20, 30 forming the magnetic circuit. At the same time, the draw lines 21, 31 of the upper and lower coils 20, 30 should be drawn through the coil guiding tracks 71*c*, 72*c* of the upper and lower electrode members 71, 72.

The reason why the upper coils 20 and the upper permanent magnet 50 forming the upper magnetic circuit, and the lower coils 30 and the lower permanent magnet 60 forming the lower magnetic circuit are attached to the integrated electrode member 70 using the double sided adhesive pads 80 is that the unification of parts is possible, and thus, due to such unification of the parts, the assembly process of the high tone vibration plate 40 to the frame 10 is more readily performed and the work efficiency and the productivity may be improved.

Figure 15:
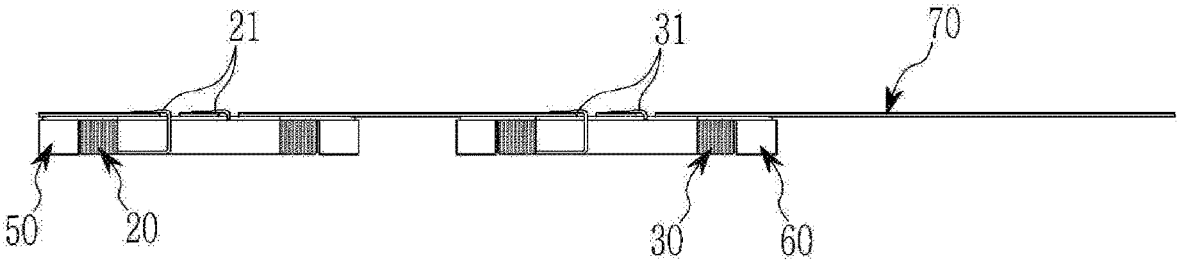

As described above, after attaching the integrated electrode member 70 on the upper and lower coils 20, 30, the draw lines 21, 31 of the upper and lower coils 20, 30 are slightly pressed and pushed toward the first and second electrode terminals 71*a*, 72*a* arranged at a side of each coil guiding track 71*c*, 72*c* using a press roller, so that the draw lines 21, 31 of the upper and lower coils 20, 30 are bent into horizontal state to thereby contact the first and second electrode terminals 71*a*, 72*a* at a side of each coil guiding track 71*c*, 72*c* (See FIG. 15).

Thereafter, ends of the draw lines 21, 31 of the upper and lower coils 20, 30 are properly cut and soldered so as to be positioned within the first and second electrode terminals 71*a*, 72*a* without extending beyond the same.

Figure 16:
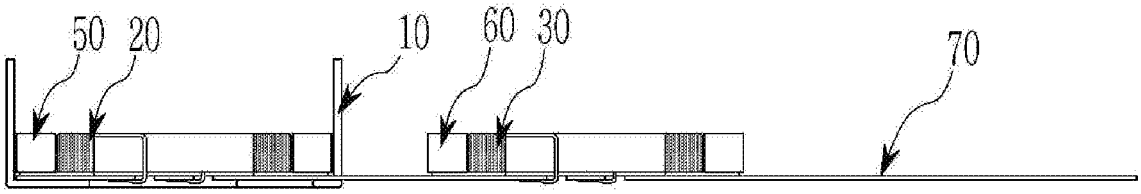

Then, the frame 10 is set on the work table with the sound emission hole 11 at a downside position and the upper electrode member 71 of the integrated electrode member 70 is inserted into the frame 10. Here, the first electrode terminal 71*a* of the upper electrode member 71 is positioned at a coil line molding hole 12 of the frame 10. At the same time, the connection track 73 of the integrated electrode member 70 is inserted in the electrode drawing slot 13, so that a temporary assembly is obtained (See FIG. 16).

Figure 17:
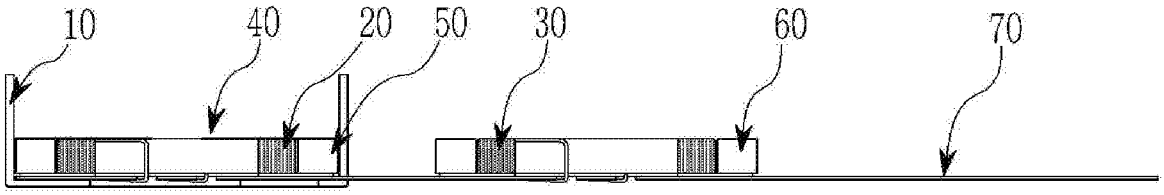
Figure 18:
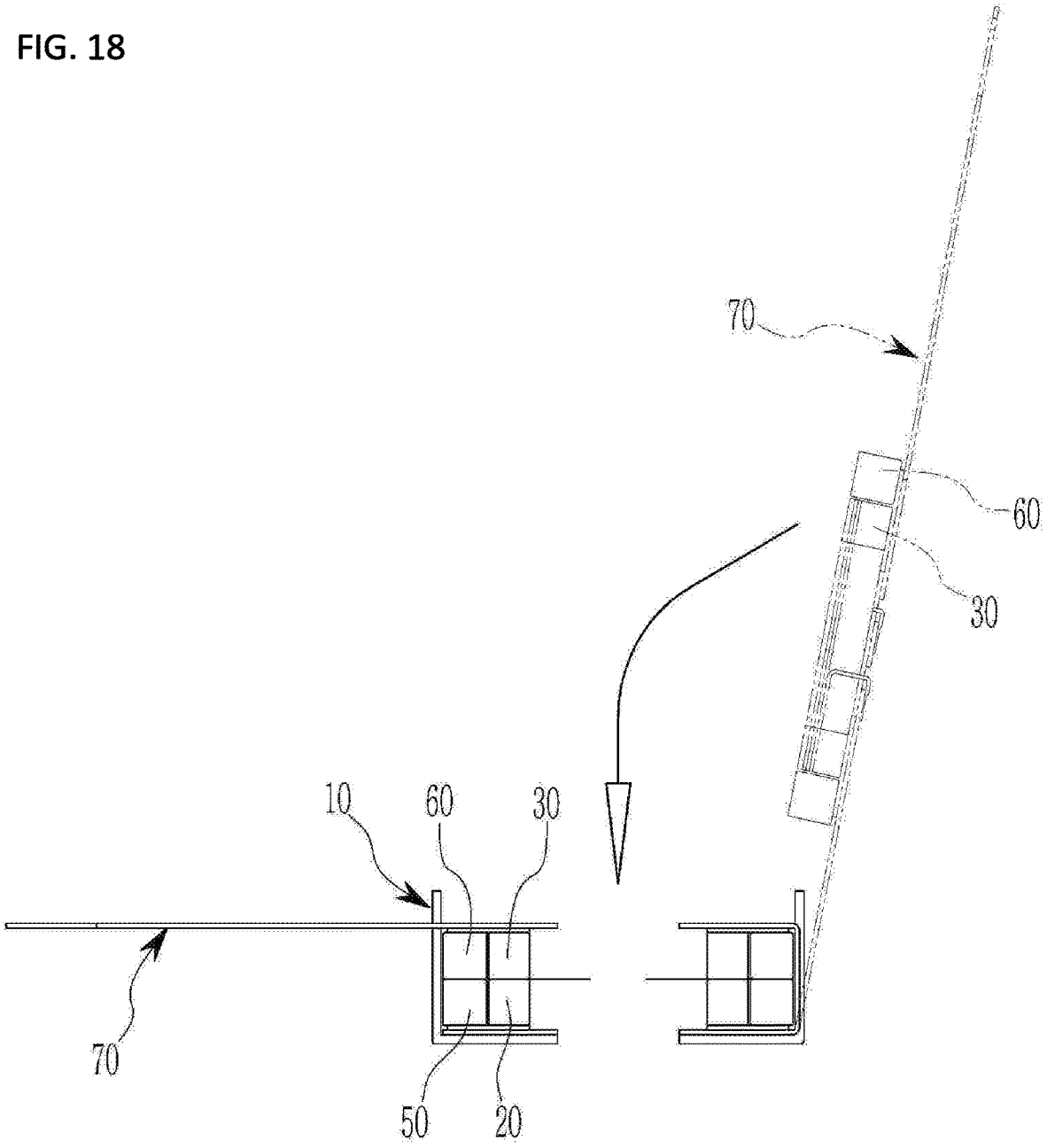

Afterward, the high tone vibration plate 40 is disposed on the upper coils 20 and the upper permanent magnet 50 as shown in FIG. 17, wherein a temporary assembly is obtained by arranging the upper coils 20 and the center hole 43 of the high tone vibration plate 40 to be concentric, and then bending either end of the connection track 73 of the integrated member 70 by 90 degree, to thereby dispose the lower coils 30 and the lower permanent magnet 60 upon the high tone vibration plate 40 (See FIG. 18).

Here, the upper coils 20 and the upper permanent magnet 50 forming the upper magnetic circuit, the lower coils 30 and the lower permanent magnet 60 forming the lower magnetic circuit and the high tone vibration plate 40 interposed there-between should be disposed to have a concentric arrangement.

Figure 19:
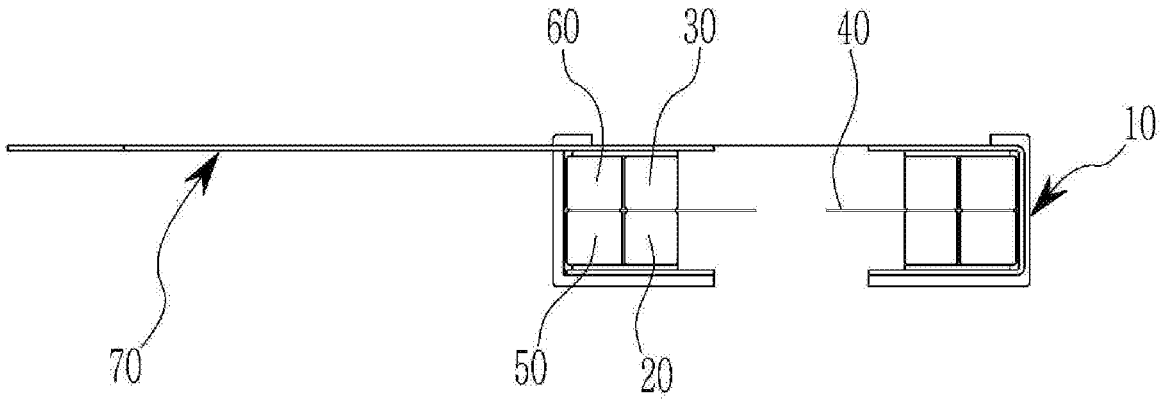

Thereafter, the frame 10 is set in a press and a lower end of the frame 10 is formed to bend inward by 90 degree, so that the upper and lower magnetic circuits are fitted within the frame 10, along with the high tone vibration plate 40 (See FIG. 19). Thereby, a speaker dedicated to high tone sound is completed. If necessary, the draw line 21 of the upper coils 20 is molded by filling epoxy resin into the coil line molding hole 12 of the frame 10.

Figure 11:
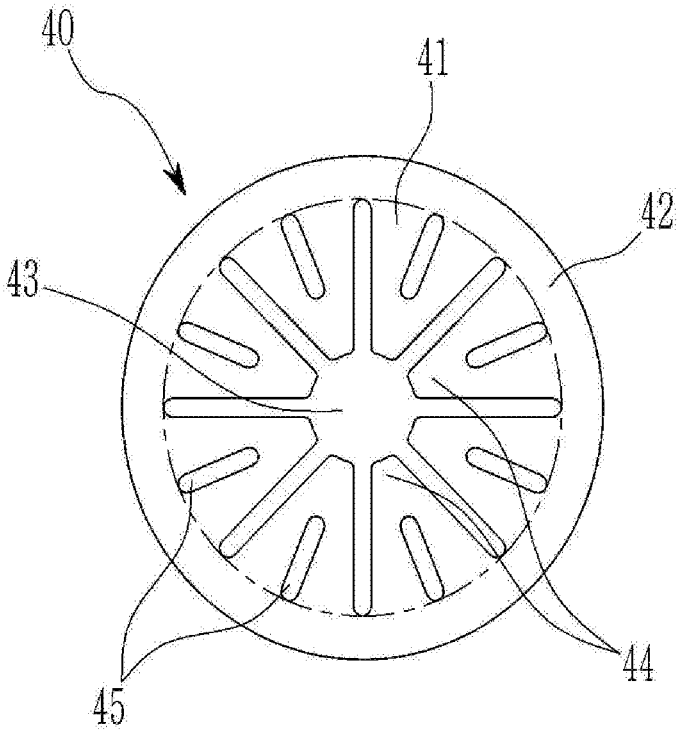
Figure 12:
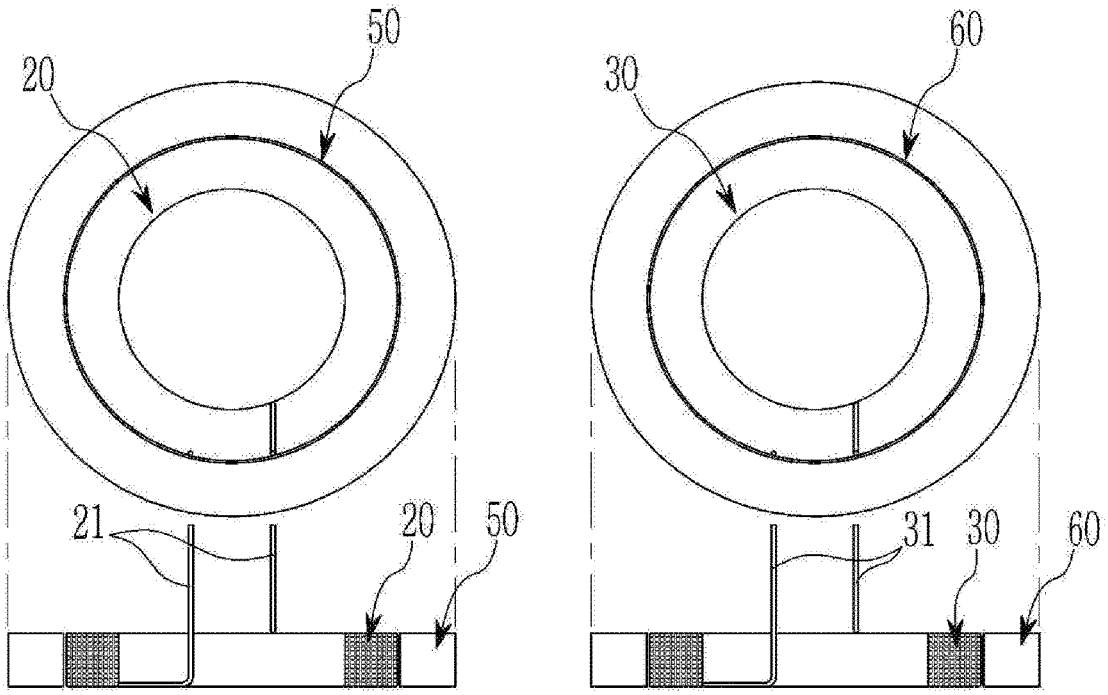
FIGS. 12 through 19 are explanatory views showing the assembly process for the tweeter applied to the hybrid speaker of the present invention.

FIG. 11 shows another embodiment of the high tone vibration plate applied to the hybrid speaker of the present invention. Here, the high tone vibration plate of an open type is provided by cutting the high tone vibration plate 40 from the hole 43 in radial directions to form a plurality of the vibration wings 44 and puncturing an adjustment hole 45 in every vibration wing 44. The adjustment hole 45 is provided in every vibration wing, but the adjustment holes are selectively formed only in some of the vibration wings.

When the high tone vibration plate of the other embodiment is applied to the hybrid speaker of the present invention described above, the areas of the holes 43 increase due to gaps between the vibration wings 44, and thus, the disappearance zone of low tone sound cannot help moving toward the zone of high tone sound. Thereby, it is possible to properly combine and adjust the diameter of the center hole 43 of the body 41, the gaps between the vibration wings 44, and the adjustment hole 45, according to the frequency of the zone of high tone sound to be obtained.

In other words, the smaller the diameter of the hole 43 and the gaps between the vibration wings 44, the lower the zone of low tone sound. The greater the diameter of the hole 43 and the gaps between the vibration wings 44, the higher the disappearing zone of low tone sound. Accordingly, only the high tone sound could be obtained since the zone of low tone sound moves toward the zone of high tone sound.

In other words, the smaller the gap between the diameter of the hole 43 and the vibration wings 44, the lower the disappearance zone of the low tone sound. The greater the gap between the diameter of the hole 43 and the vibration wings 44, the higher the disappearance zone of low tone sound. Thus, the zone of low tone gets higher.

Figure 20:
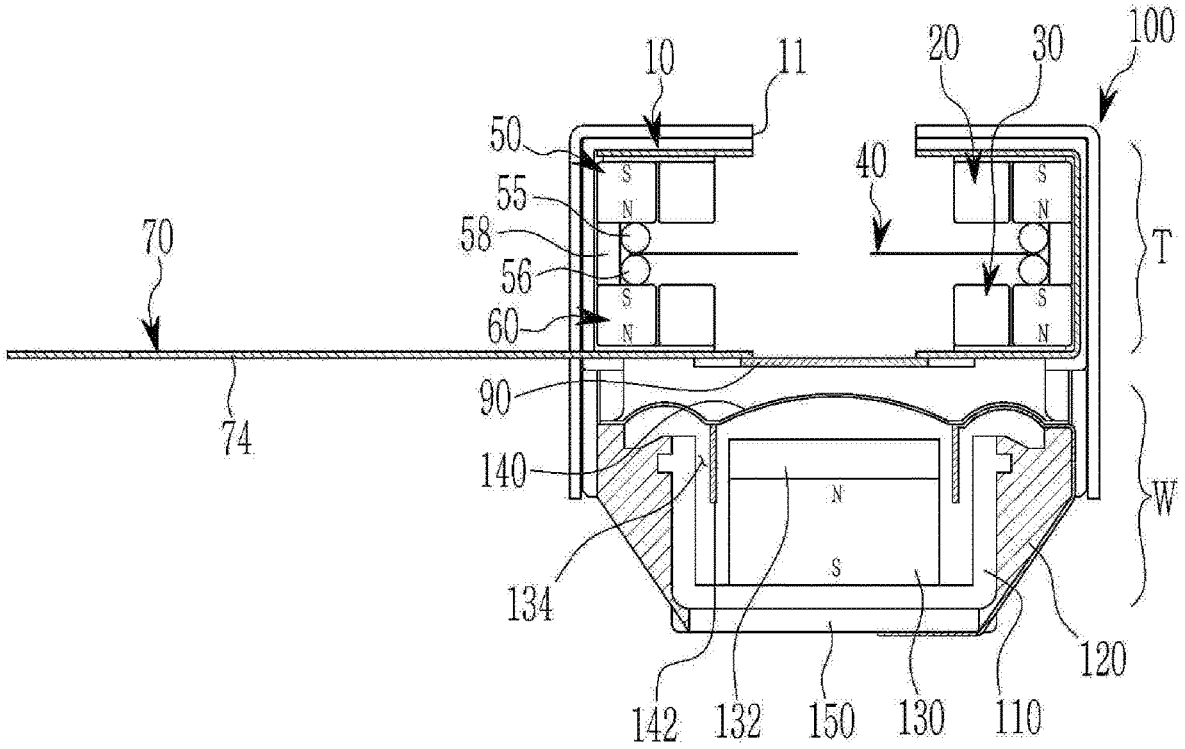
FIG. 20 shows other embodiment of the tweeter applied to the hybrid speaker of the present invention.

FIG. 20 shows another embodiment of the tweeter applied to the hybrid speaker of the present invention. Here, the embodiment in FIG. 20 is substantially the same as that described above. Exceptionally, the high tone vibration plate 40 is supported between the upper and lower damping members 55, 56 and the gap guide 58 is provided for establishing sufficient space between the upper and lower permanent magnets 50, 60 outside the upper and lower damping members 55, 56.

As to the tweeter of the hybrid speaker applied to the embodiment described, the upper and lower damping members 55, 56 include non-magnetic materials, such as polymer, synthetic resin, silicon, wherein the modulus of elasticity can be controlled. Thus, the high tone vibration plate 40 may vibrate in an easy way and the damping operation may be carried out in an efficient way. Accordingly, the fine reproduction of the sound is possible and the fidelity in the zone of high tone is improved.

Also, each of the upper and lower damping members 55, 56 has a circular shaper, a semi-circle shape or a concave shape, and thus, a balanced position of the high tone vibration plate 40 and non-adhesive damping coupling of the high tone vibration plate 40 could be efficiently achieved.

Figure 21:
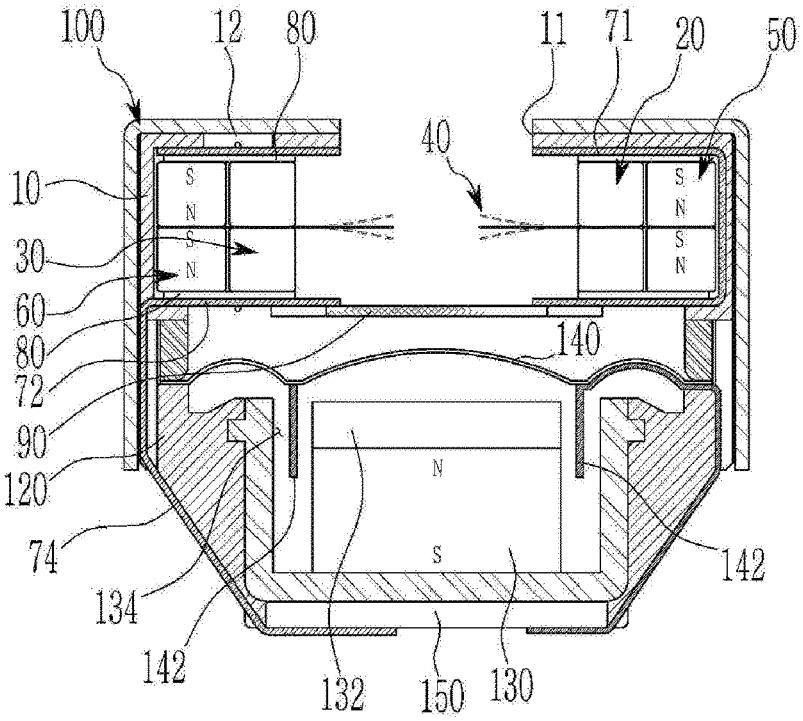
FIG. 21 is a cross sectional view and a bottom view showing a hybrid speaker of other embodiment according to the present invention.
Figure 21:
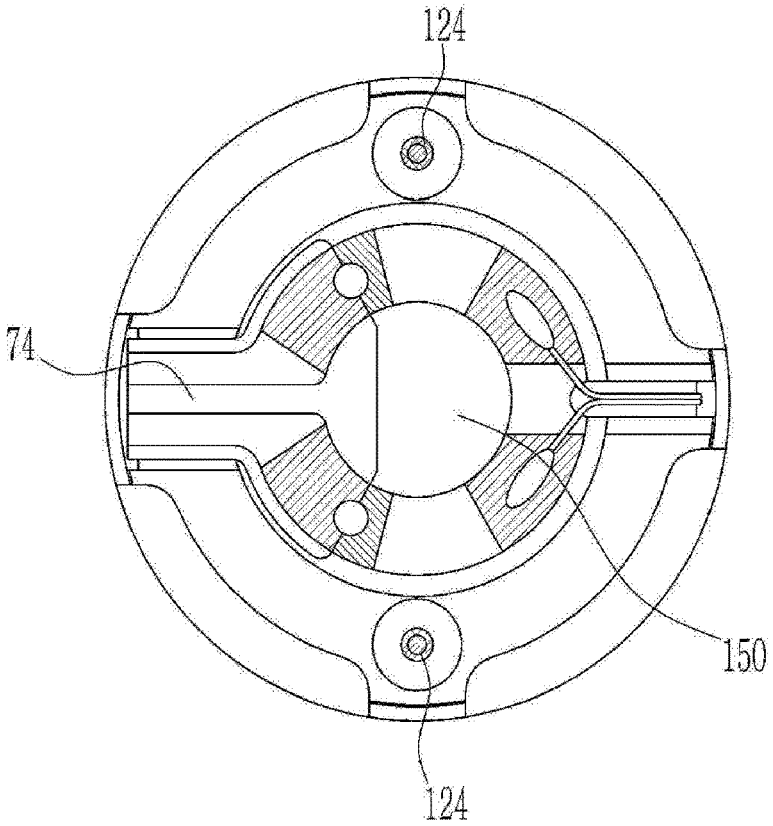

FIG. 21 shows other hybrid speaker according to other embodiment of the present invention. Here, the outer electrode terminal member 74 of the integrated electrode member 70 of the tweeter T is bent to reach the substrate 150 for the low tone sound of the woofer W, and the third electrode terminal 74*a* located at the end of the outer electrode terminal member 74 is connected to the substrate 150 for low tone sound of the woofer W.

With the hybrid speaker of the above described embodiment, the integrated electrode member 70 of the tweeter T is not exposed to outside, to thereby facilitate the installation of the speaker.

Figure 22:
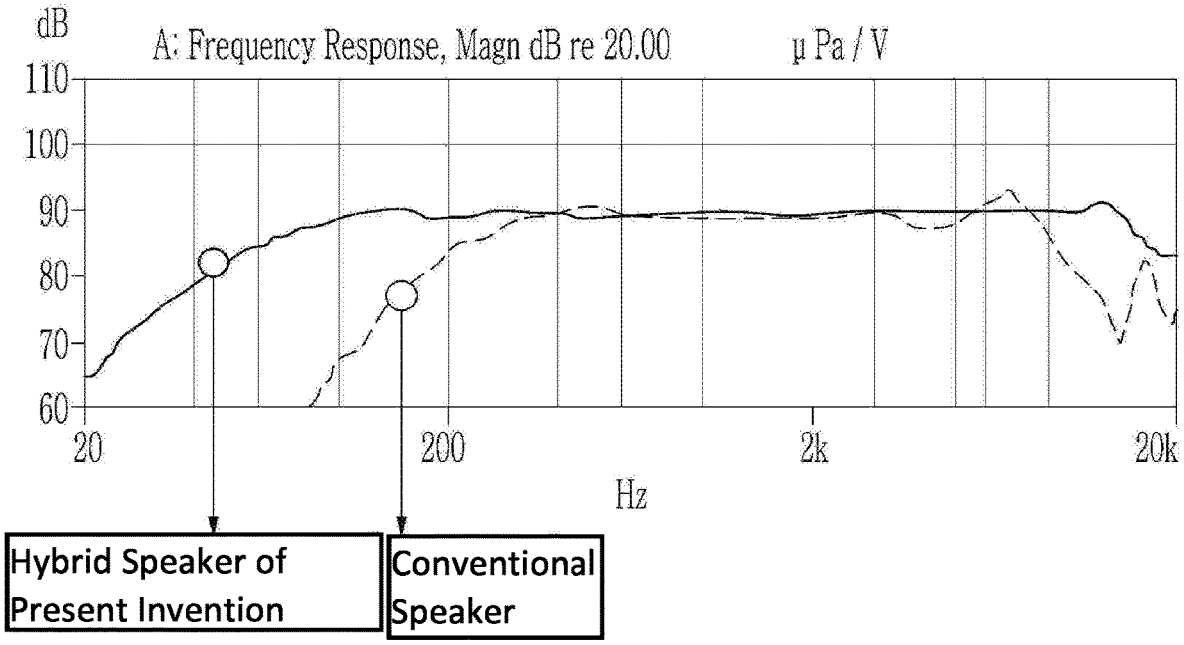
FIG. 22 is a graph showing the characteristic of the frequency response of the hybrid speaker according to the present invention compared to the characteristic of the frequency response of the conventional speaker.

FIG. 22 is the graph showing the frequency response characteristics of the speaker according to the present invention compared to the frequency response characteristics of the speaker according to the prior arts.

The characteristics of the conventional electro-magnetic speaker as a single speaker range from about 200 Hz to 10 kHz. However, the dynamic speaker for low tone part has no trouble for achieving a low tone frequency, and the electro-magnetic high resolution speaker dedicated to high tone sound, which reproduces only high frequency while eliminating low frequency by itself, has such characteristic as to finely reproduce a zone of high tone sound extending to a zone of ultrahigh frequency, since the vibration plate has very light mass and moves along an arch path.

As a result, the synthetic characteristics of the hybrid speaker may attain the reproduction of ultra wide band, which ranges from the frequency lower than 80 Hz to the frequency higher than 20 kHz, i.e., the audible limit frequency, wherein the hybrid speakers comprises two coaxial-combined speakers. Since the high tone limit frequency of the dynamic low tone speaker and the low tone limit frequency of the electro-magnetic high resolution speaker are harmonically combined and engaged in a single body, loss and distortion due to non-coaxial state could be minimized. Accordingly, the higher quality sound, which has clearness and significant degree of separation, could be reproduced, and the engagement of the characteristics could be smoothly engaged within a crossover zone wherein the low tone and the high tone overlap.

The process for driving the hybrid speaker according to the present invention will be briefly described below. When the tweeter T of the hybrid speaker according to the present invention is driven, low tone sound disappears due to anti-phase and only high tone sound is generated by means of the vibration wings 44 of the tweeter T in the hybrid speaker of the present invention as described above.

When the woofer W is driven, low tone sound is generated due to the vibration of the low tone vibration plate 140 of the woofer W. Here, with regard to sound ranging from mid-tone to high-tone that is mixed with low tone sound, undulation of the frequency characteristics is alleviated by the resister 90 for controlling high tone, to thereby refine the sound. Thereafter, only low tone sound is generated through the closed-type hole 43 formed in the high tone vibration plate 40 of the tweeter T and through the slot formed between the vibration wings 44.

Of course, the tweeter T and the woofer W are separately driven. At the same time, the tweeter T and the woofer W are collectively driven to thereby obtain such effect as the multi-way speaker.

The present invention has been described herein-above with reference to the specific embodiments, but the present invention is not limited to the embodiments and the drawings described in the specification. Also, the present invention could be varied by one of ordinary skill in the art within the scope that does not go beyond the technical concept of the present invention. Further, the present invention covers any design matter as long as the operational principle and the arrangement of the parts are consistent with the equivalent concept of the present invention.

INDUSTRIAL APPLICABILITY

The present invention may be utilized in the field of the hybrid speaker employed in a smart phone, a portable computer, a communication device and an earphone, which requires the enlargement of band from a zone of low tone to a zone of high tone and requires a higher sound quality.

The invention claimed is:

1. A hybrid speaker comprising a tweeter and a dynamic woofer, wherein the tweeter has upper and lower coils arranged opposite to each other, an open-type high-tone vibration plate formed with a closed-type center hole at its center and located between the upper and lower coils, and one or more permanent magnets arranged outside the upper and lower coils, and wherein the woofer is coaxially coupled to a lower side of the tweeter so as to let low tone sound generated from a low tone vibration plate of the woofer pass through the hole of the high tone vibration plate of the tweeter.

2. The hybrid speaker as claimed in claim 1, further comprising a porous resister for controlling high tone sound, which is located between the high tone vibration plate of the tweeter and the low tone vibration plate of the woofer.

3. The hybrid speaker as claimed in claim 1, wherein the tweeter and the woofer have a coaxial housing for coaxial coupling by enclosing their frames and a circumferential surface of a basket.

4. The hybrid speaker as claimed in claim 1, wherein the high tone vibration plate of the tweeter is supported by upper and lower damping members and wherein a gap guide is provided for establishing a sufficient space between the upper and lower permanent magnets outside the upper and lower damping members.

5. The hybrid speaker as claimed in claim 1, wherein the high tone vibration plate has a plurality of vibration wings, each of which is formed by cutting an inner periphery of the hole of the high tone vibration plate in a radial direction.

6. The hybrid speaker as claimed in claim 5, wherein the vibration wings of the high tone vibration plate are formed with adjustment holes.

7. The hybrid speaker as claimed in claim 1, wherein the upper and lower coils have an integrated electrode member made of flexible printed circuit board (FPCB), which covers an upper surface of the upper coils, side surfaces of the upper and lower coils and a lower surface of the lower coils, so as to make parallel coupling wherein plus terminals are coupled to each other and minus terminals are coupled to each other.

8. The hybrid speaker as claimed in claim 7, wherein the integrated electrode member comprises:

an upper electrode member covering the upper surface of the upper coils;

a lower electrode member covering the lower surface of the lower coils;

a connection track connecting the upper and lower electrode members; and an outer electrode terminal member extending from the lower electrode member to form a straight line with the connection track.

9. The hybrid speaker as claimed in claim 8, wherein the upper coils and the upper permanent magnet are attached to the upper electrode member using double-sided pad and the lower coils and the lower permanent magnet are attached to the lower electrode member using double-sided pad.

10. The hybrid speaker as claimed in claim 7, wherein the outer electrode terminal member of the integrated electrode member is bent to be connected to a substrate for low tone sound of the woofer, so as to separately drive the tweeter and the woofer and collectively drive the tweeter and the woofer at the same time, to thereby obtain effect of multi-way speaker.

* * * * *